US005955730A

United States Patent [19]

Kerley et al.

[11] Patent Number: 5,955,730

[45] Date of Patent: Sep. 21, 1999

[54] REFLECTION TIME-OF-FLIGHT MASS SPECTROMETER

[75] Inventors: Eric L. Kerley, Knoxville; Robert E. Haufler, Oak Ridge, both of Tenn.

[73] Assignee: Comstock, Inc., Oak Ridge, Tenn.

[21] Appl. No.: 08/883,623

[22] Filed: Jun. 26, 1997

[51] Int. Cl.[6] ..... H01J 49/40

[52] U.S. Cl. ..... 250/287

[58] Field of Search ..... 250/287, 281, 250/282

[56] References Cited

U.S. PATENT DOCUMENTS

| | | | |
|---|---|---|---|
| 3,727,047 | 4/1973 | Janes | 250/287 |
| 4,731,532 | 3/1988 | Frey | 250/287 |
| 5,032,772 | 7/1991 | Boesl et al. | 250/287 |
| 5,117,107 | 5/1992 | Guilhaus | 250/287 |
| 5,144,127 | 9/1992 | Williams et al. | 250/287 |
| 5,202,563 | 4/1993 | Cotter et al. | 250/287 |

FOREIGN PATENT DOCUMENTS 3428944 8/1984 Germany .

OTHER PUBLICATIONS

Pierce, J.R. *Theory and Design of Electron Beams*, 2nd Edtion, Van Nostrand, New York (1954).

Sanzone, G. Energy Resolution of the Conventional Time–of–Flight Mass Spectrometer, *The Review of Scientific Instruments*, vol. 41, No. 5, 741–2 (May, 1970).

de Heer, W.A., P. Milani, Large Ion Volume Time–of–Flight Mass Spectrometer with Position–and–Velocity–Sensitive Detection Capabilities for Cluster Beams, *Rev. Sci. Instrum.*, vol. 62, No. 3, 670–7 (Mar., 1991).

Sinha, M.P., G. Gutnikov, Development of a Miniaturized Gas Chromatograph–Mass Spectrometer with a Microbore Capillary Column and an Array Detector, *Analytical Chemistry*, vol. 63, No. 18, 2012–6 (Sep., 1991).

Guilhaus, M., Spontaneous and Deflected Drift–Trajectories in Orthogonal Acceleration Time–of–Flight Mass Spectrometry, *Journal of the American Society for Mass Spectrometry*, vol. 5, 588–595 (1994).

Meuzelaar, H.L.C., Man–Portable GC/MS; Opportunities, Challenges and Future Directions, Center for Micro Analysis & Reaction Chemistry, University of Utah.

*Primary Examiner*—Kiet T. Nguyen
*Attorney, Agent, or Firm*—Pitts & Brittian, P.C.

[57] ABSTRACT

An improved reflectron time-of-flight mass spectrometer having improved design features in both the ion source and the ion reflection region. The ion source employs a near-ground voltage configuration and second-order spatial focusing of generated ions. The ion mirror is a new two-stage, second-order-corrected, energy-focusing, gridless design. The near-ground voltage configuration of the source, the second-order spatial focusing design of the source, and the new ion mirror serve to yield superior mass resolution, superior sensitivity, and superior safety, utility, and operational characteristics.

4 Claims, 5 Drawing Sheets

REFLECTION TIME-OF-FLIGHT MASS SPECTROMETER

TECHNICAL FIELD

This invention relates to the field of mass spectrometry. More specifically, this invention relates to an improved reflectron-type mass spectrometer having a near-ground voltage configuration, a second-order spatial focusing ion source, and a two-stage, second-order-corrected, energy focusing, gridless ion mirror.

BACKGROUND ART

In the field of mass spectrometry, time-of-flight (TOF) techniques are well known. Typical of those techniques and principles of electron beam characteristics are discussed in the following articles and United States patent:

Pierce, J. R., *Theory and Design of Electron Beams,* 2nd Edition, Van Nostrand, New York (1954).

Sanzone, G., Energy Resolution of the Conventional Time-of-Flight Mass Spectrometer, *The Review of Scientific Instruments,* Volume 41, Number 5, 741–2 (May, 1970).

de Heer, W. A., P. Milani, Large Ion Volume Time-of-Flight Mass Spectrometer with Position- and Velocity-Sensitive Detection Capabilities for Cluster Beams, *Rev. Sci. Instrum.,* Volume 62, No. 3, 670–7 (March, 1991).

Sinha, M. P., G. Gutnikov, Development of a Miniaturized Gas Chromatograph-Mass Spectrometer with a Microbore Capillary Column and an Array Detector, *Analytical Chemistry,* Volume 63, Number 18, 2012–6 (September, 1991).

Guilhaus, M., Spontaneous and Deflected Drift-Trajectories in Orthogonal Acceleration Time-of-Flight Mass Spectrometry, *Journal of the American Society for Mass Spectrometry,* Volume 5, 588–595 (1994).

Meuzelaar, H. L. C., *Man-Portable GC/MS, Opportunities, Challenges and Future Directions,* Center for Micro Analysis & Reaction Chemistry, University of Utah.

U.S. Pat. No. 5,117,107, entitled "Mass Spectrometer", issued to M. Guilhaus, et al., on May 26, 1992, for which Reexamination Certificate No. B1 5,117,107 was issued on Sep. 13, 1994.

Reflectron-type time-of-flight mass spectrometers are disclosed in U.S. Pat. Nos. 4,731,532 issued to R. Frey, et al., on Mar. 15, 1988; and 5,032,722 issued to U. Boesl, et al., on Jul. 16, 1991.

Time-of-flight mass spectrometers of the reflectron type incorporating an ion mirror have also been disclosed in U.S. Pat. No. 3,727,047, issued to Janes in April, 1973, and in German patent application No. 34 28 944. The ion mirror or reflector in these spectrometers is comprised of a series of grid electrodes to which voltages are applied to compensate for time differences in the total time of flight of the ions caused by different initial energies of the ions produced and subsequently accelerated out of the source region. This compensation results in improved mass resolution over the case of a linear (un-reflected) spectrometer. These gridded instruments suffer from loss of sensitivity due to ions being scattered or absorbed by the grids. Even if the grids are highly transmitting, significant losses will occur. For instance, reflection of an ion beam through five 80% transmitting grids will reduce instrument sensitivity by 90%.

The '532 patent referenced above discloses a gridless reflectron. However this instrument employs an entirely different voltage scheme from the present invention. The device disclosed in the '532 patent incorporates diaphragm rings in the two-stage ion mirror defining c\varied diameters.

As a result, manufacture, assembly, and servicing of the instrument are complicated. Further, transmission of the ions is reduced, as well as mass resolution.

Accordingly, it is an object of the present invention to provide a reflectron-type time of flight mass spectrometer (TOF-MS) constructed in such a manner as to facilitate manufacture, assembly and servicing thereof In light of this object, it is an object of the present invention to provide such a TOF-MS having a two-stage ion mirror having diaphragm rings each configured identical one to another in order to increase ion transmission and mass resolution.

It is a further object of the present invention to provide a TOF-MS having an ion mirror which is a two-stage mirror being second-order-corrected, energy-focusing and gridless.

Further, it is an object of the present invention to provide a TOF-MS having an ion source employing a near-ground voltage configuration.

DISCLOSURE OF THE INVENTION

Other objects and advantages will be accomplished by the present invention which is a reflectron-type time-of-flight mass spectrometer (TOF-MS) which includes new and improved design features in both the ion source and the ion reflection region. The ion source employs a near-ground voltage configuration and second-order spatial focusing of generated ions. The ion mirror is a new two-stage, second-order-corrected, energy-focusing, gridless design. The mirror uses a single stack of identical diaphragm rings for the two stage mirror design. This results in advantageous curved equipotential lines that correct for diverging ion trajectories thereby causing all ions to strike the detector surface.

The TOF-MS comprises an ion source and a detector which are interconnected by the flight path. Surrounding the flight path are the floating flight tube liners which float at the potential of the entrance to the ion mirror, or reflector. The ion mirror includes two series of concentric ring diaphragm electrodes. The major deceleration of the ions occurs during ion passage through the first series of rings. The ions turn and are reflected and focused back on the detector in the near flat-field region of the second ring series. Each of the diaphragm rings is of equal diameter. Further, in contrast to the prior art, the entrance is devoid of any special lens electrode. Thus, the present mirror is "lensless". Paths of reflected ions penetrate the equipotential field lines within the flight tubes and mirror.

The reflectron ion mirror structure serves to reflect and focus ions with the same mass, but different energies of formation in the ion source, so that they arrive at the same time at the detector. The present invention uses a second-order energy focusing criterion.

The ion source employs second-order spatial correction. That is, an algebraic expression is calculated for the total time-of-flight of the ions from the instant they first experience the repeller voltage to the time that they strike the detector surface. The first and second derivatives of this expression with respect to the flight axis co-ordinate are then equated to zero, and the positions of the source repeller and extraction electrodes derived.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

An improved reflectron time-of-flight mass spectrometer (TOF-MS) incorporating various features of the present invention is illustrated generally at 10 in the figures. The improved reflectron TOF-MS 10 includes new and improved design features in both the ion source and the ion reflection region. The ion source employs a near-ground voltage configuration and second-order spatial focusing of generated ions. The ion mirror is a new two-stage, second-order-corrected, energy-focusing, gridless design.

Figure 1:
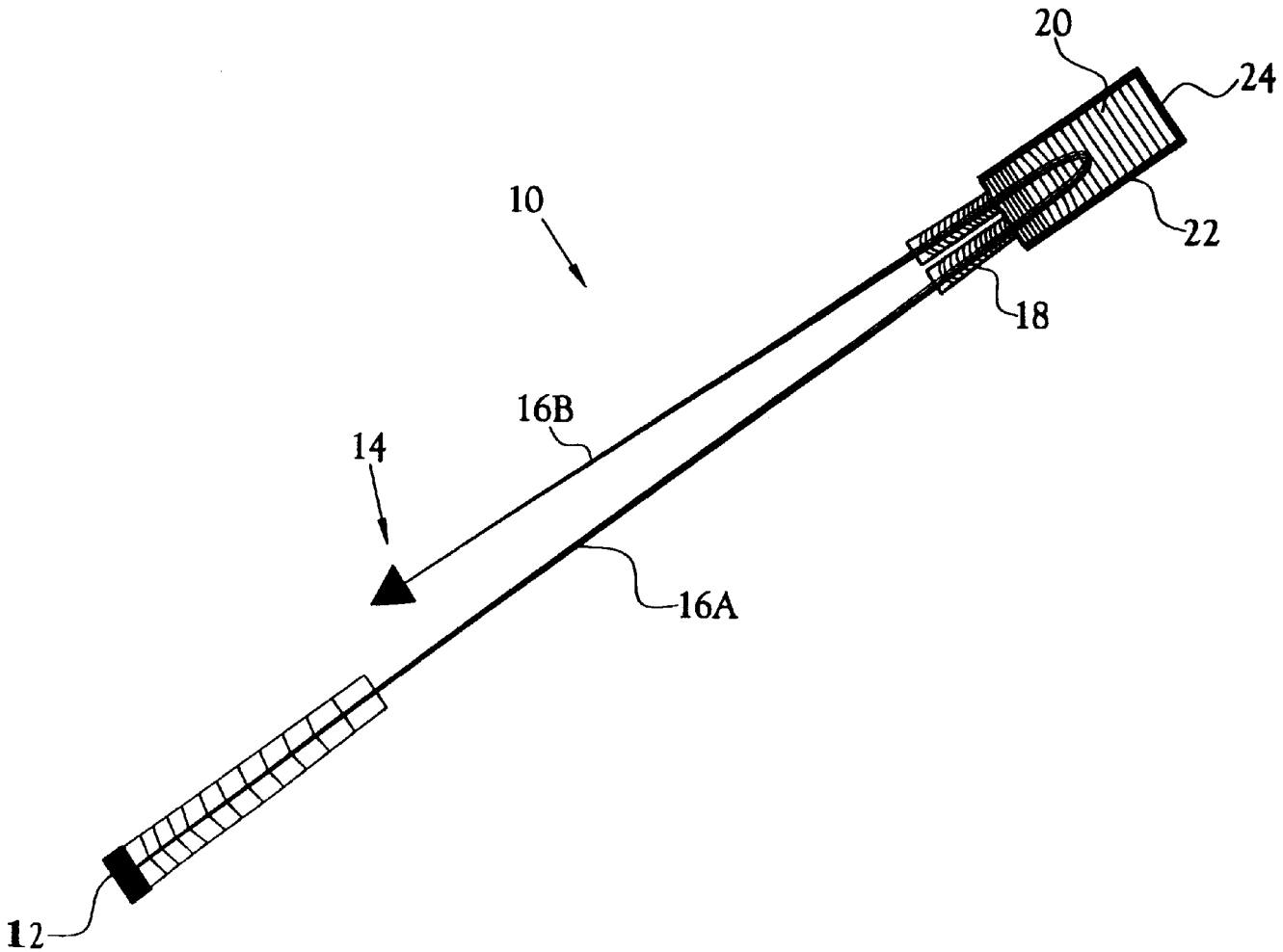
FIG. 1 is a schematic illustration of the improved reflectron time-of-flight mass spectrometer constructed in accordance with several features of the present invention.

The TOF-MS 10 shown schematically in FIG. 1 comprises an ion source 12 and a detector 14 which are interconnected by the flight path 16A,B. Surrounding the flight path 16A,B are the floating flight tube liners (not shown) which float at the potential of the entrance to the ion mirror, or reflector, 20. The ion mirror 20 includes two series of concentric ring diaphragm electrodes 22,24. The major deceleration of the ions occurs during ion passage through the first series of rings (R2–R5) 22. The ions turn and are reflected and focused back on the detector in the near flat-field region of the second ring series (R6–R21) 24. Because the two stages of the ion mirror 20 use identical ring diaphragm electrodes 22,24 that are not separated by a grid, the equipotential lines are curved as shown. This structure is designed to compensate for the divergence of the ion trajectories. The absence of grids and the curvature of the equipotential lines makes the ion transmission through the improved reflectron very high.

Figure 2:
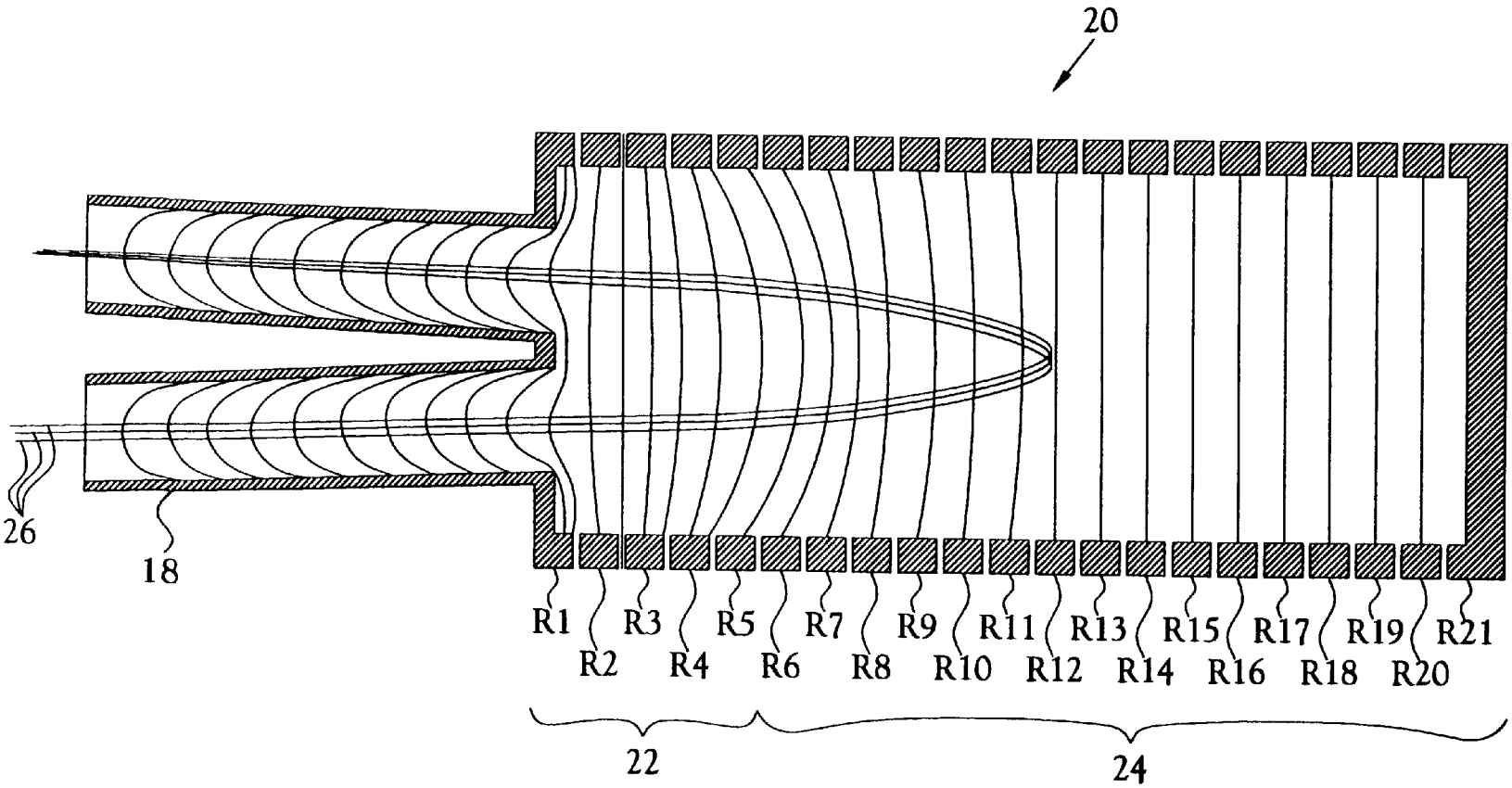
FIG. 2 illustrates the ion reflector electrodes of the ion mirror, showing the ion flight paths and equipotential surfaces created by the diaphragm rings.
Figure 3:
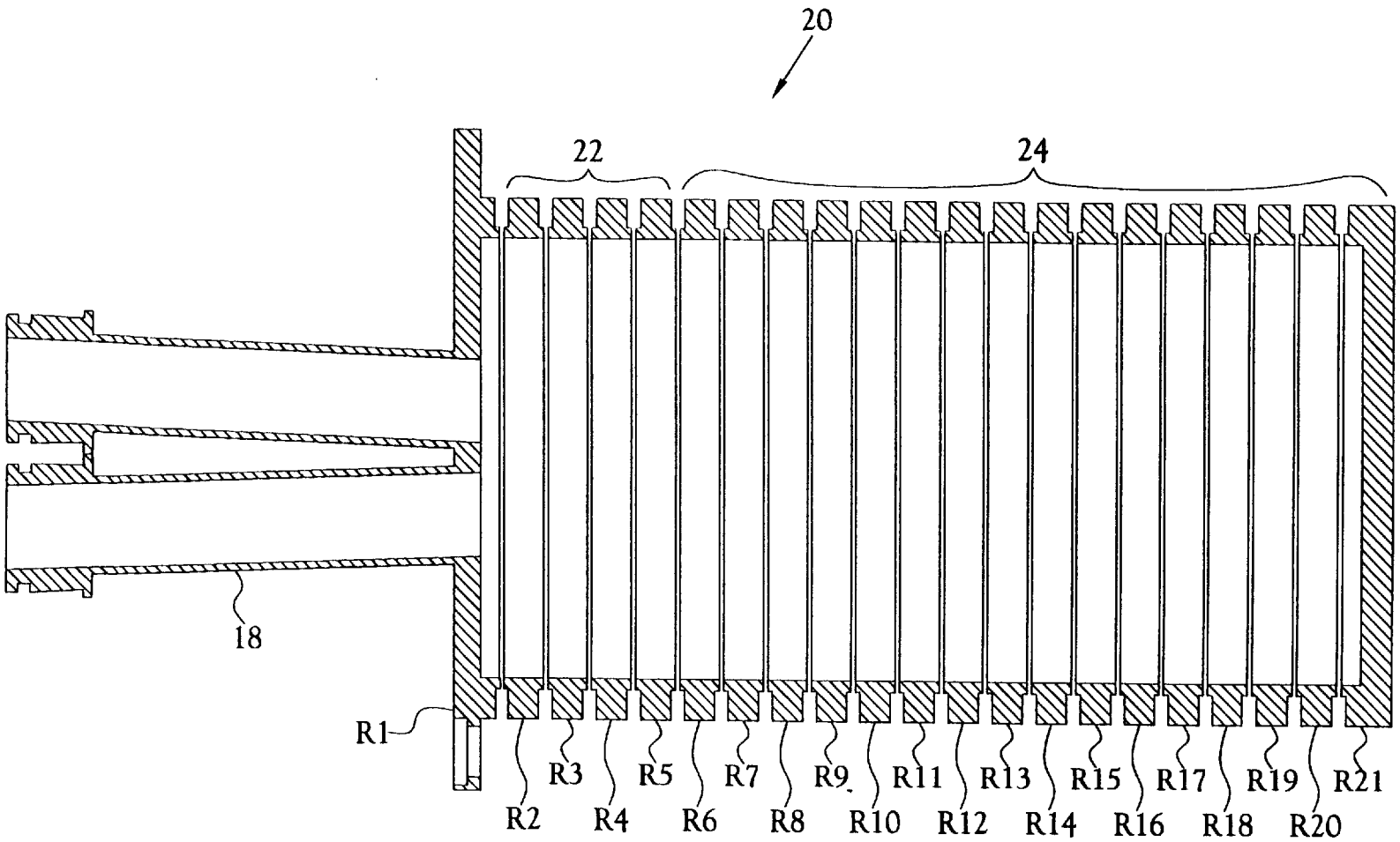
FIG. 3 is a cross-section view of the flight tubes and ion reflector of one embodiment of the present invention.

Illustrated in FIG. 2 is an arrangement of the ion reflector electrodes R1–R22 of one embodiment of the present invention, in cross-section. Each of the diaphragm rings R2–R20 is of equal diameter. Further, in contrast to the prior art, the entrance at R1 is devoid of any special lens electrode. Thus, the present mirror is "lensless". Paths of reflected ions 26 are shown penetrating the equipotential field lines within the flight tubes 18 and mirror 20. FIG. 3 is more illustrative of the physical configuration of the diaphragm rings R1–R21 and the mounting of the flight tubes 18 onto the ion mirror 20.

Figure 4:
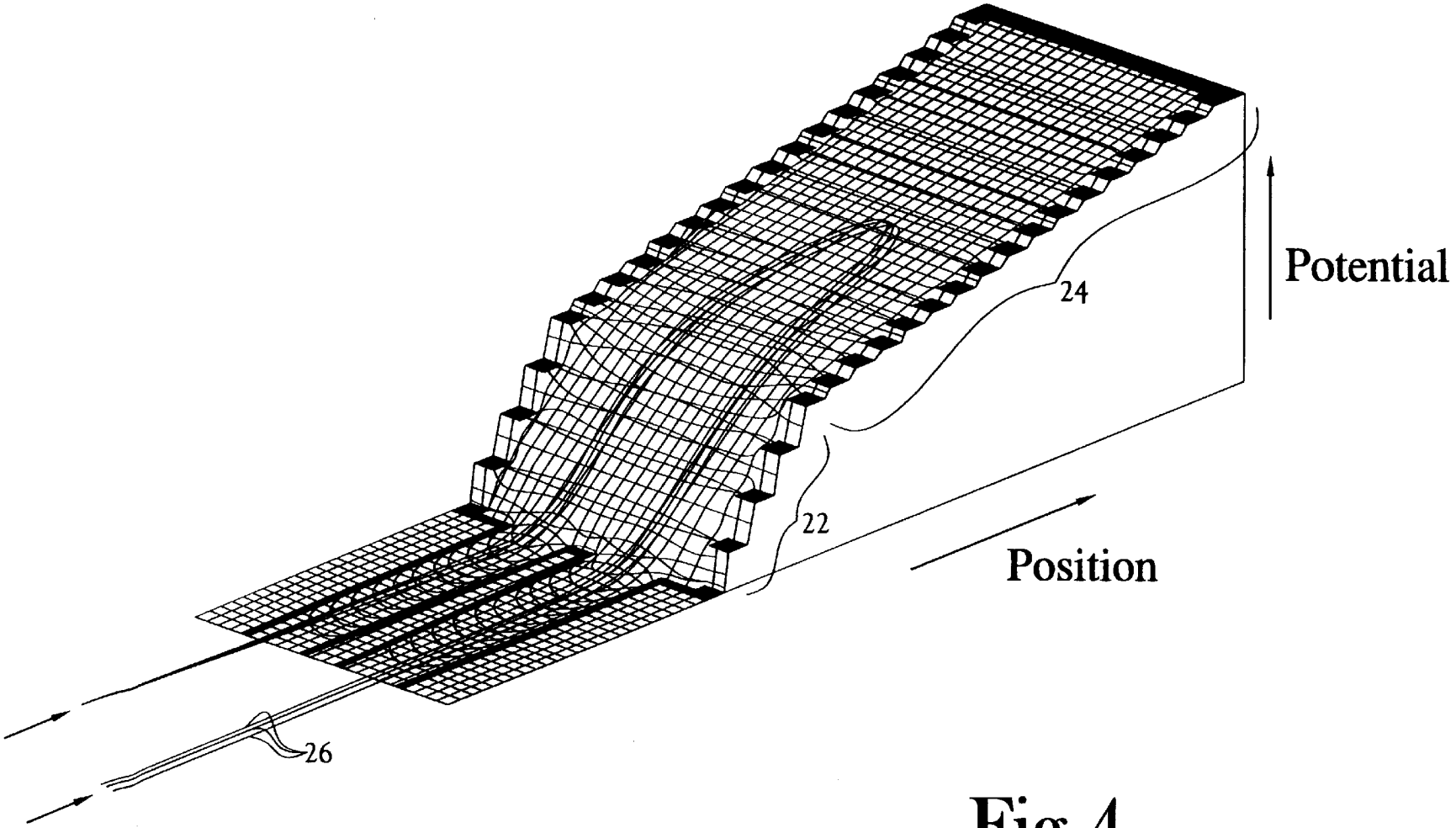
FIG. 4 is a graphical illustration of the two-stage second order corrected ion mirror potential.

FIG. 4 illustrated graphically the two-stage second-order corrected ion mirror potential. The gradient break between the two stages is clearly demarcated. In the preferred embodiment of the present invention, the initial and terminating diaphragm rings R1 and R21 are one-half the thickness of the intermediate diaphragm rings R2–R20. This results in perfect field termination of the constant gradient fields at each end of the ion mirror 20. It will be seen that the present invention is also devoid of a final focusing electrode, as disclosed in the prior art.

The reflectron ion mirror 20 structure serves to reflect and focus ions with the same mass, but different energies of formation in the ion source, so that they arrive at the same time at the detector 14. The present invention uses a second-order energy focusing criterion. That is, an algebraic expression is derived for the flight time of the ions from point of formation to the detector 14 via the ion reflector 20. The first and second derivatives of this expression with respect to the energy of formation of the ions are also calculated and then equated to zero. From these equations values are obtained for ring diaphragm spacings and voltages in the ion mirror 20.

In one example of the present invention, the diaphragm rings R1–R22 are spaced at one (1) cm intervals. In this example, the inner diameter of each diaphragm ring R1–R21 is 10.2 cm. In this example, the potential, measured in Volts, at each diaphragm ring is as tabulated below:

| Electrode | Center position (cm) | Inner diameter (cm) | Potential (volts) |
|---|---|---|---|
| 1 (flight tube end, 1st half width ring) | 0.0 | 10.2 | −2000 |
| 2 (1st full width ring) | 1.0 | 10.2 | −1613 |
| 3 | 2.0 | 10.2 | −1226 |
| 4 | 3.0 | 10.2 | −840 |
| 5 | 4.0 | 10.2 | −453 |
| 6 | 5.0 | 10.2 | −363 |
| 7 | 6.0 | 10.2 | −273 |
| 8 | 7.0 | 10.2 | −183 |
| 9 | 8.0 | 10.2 | −93 |
| 10 | 9.0 | 10.2 | −3 |
| 11 | 10.0 | 10.2 | +87 |
| 12 | 11.0 | 10.2 | +177 |
| 13 | 12.0 | 10.2 | +267 |
| 14 | 13.0 | 10.2 | +357 |
| 15 | 14.0 | 10.2 | +447 |
| 16 | 15.0 | 10.2 | +537 |
| 17 | 16.0 | 10.2 | +627 |
| 18 | 17.0 | 10.2 | +717 |
| 19 | 18.0 | 10.2 | +807 |
| 20 | 19.0 | 10.2 | +897 |
| 21 (last element, half ring) | 20.0 | 10.2 | +987 |

The illustrated ion reflector 20 described above provides perfect focusing both in time and geometry, for an ion drift energy of 2000V, an angle of 4 degrees between entry and exit flight tubes, and a drift path length of 2 m. These values have been achieved through experimentation. Measured transmission through the ion mirror 20 was 92%. This measurement was carried out by means of single particle detectors located directly after the ion mirror (linear transmission with voltages on the ion mirror electrodes set to the flight tube voltage) and located at the final flight tube exit.

Figure 5:
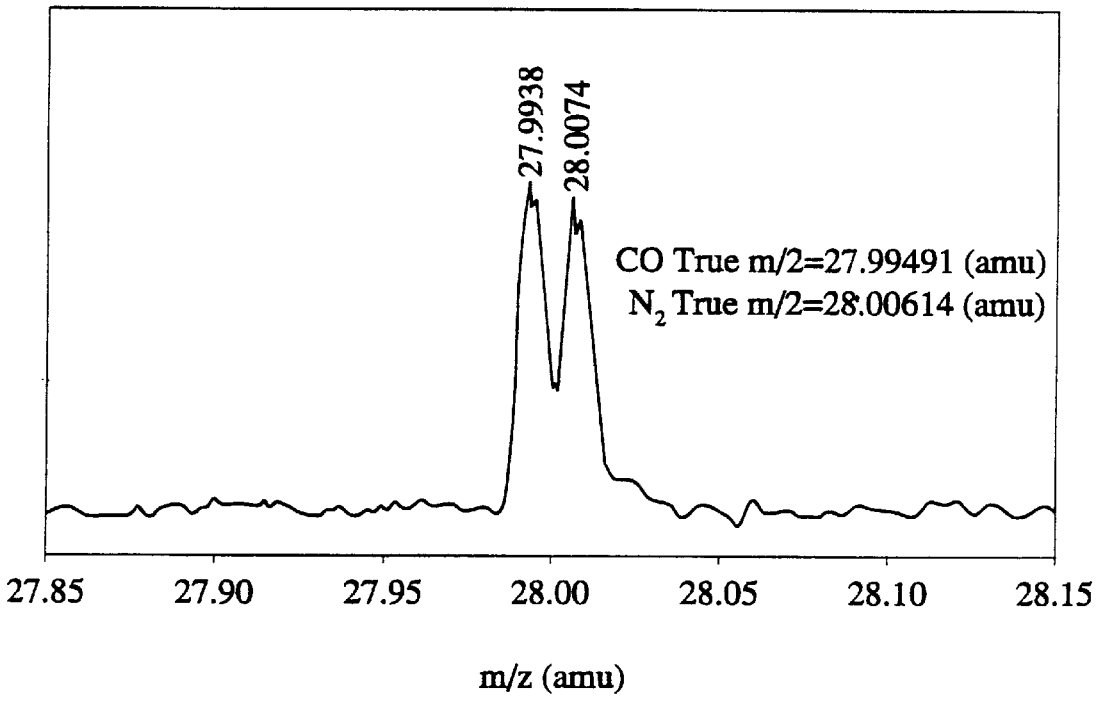
FIG. 5 is a graphical illustration of a sample mass spectrum obtained using the present invention.

A sample mass spectrum obtained with the present invention is shown in FIG. 5. This spectrum was obtained by a conversion of the observed time-of-flight spectrum of $CO^+$ and $N_2^+$ ions from a mixture of CO and $N_2$ gases leaked into the ion source where the CO and $N_2$ molecules were ionized by electron impact. The configuration of the ion source followed the second-order split focusing conditions illustrated in FIG. 4. The energy of the ionizing electron beam was 70 eV. The resolution of the instrument is shown by the splitting of the $CO^+$ and $N_2^+$ peaks which are separated by only 0.01 atomic mass units. Results with mass resolution m/dm >5000 have been obtained under these conditions.

Although specific conditions, dimensions, and other values have been disclosed for one embodiment of the present invention, and for a particular experimentation, it will be understood that such disclosure is not intended to limit the present application to such disclosure.

In the preferred embodiment of the present invention, mechanical mounting and accurate location and spacing of the diaphragm rings R1–R21 of the ion mirror 20 is carried out by means of accurately formed synthetic ruby or other insulating balls located in holes drilled in the rings R1–R21. Successive rings R1–R21 are bolted to each other in the stack by insulated recessed cap screws. The potentials are applied to the diaphragm rings R1–R21 via resistor-divider networks of vacuum compatible resistors attached between the rings R1–R21 by screws. The input voltage is supplied via electrical vacuum feedthroughs located in the vacuum chamber wall. The flight tubes are supplied in a similar manner. The whole mirror assembly is supported, insulated and located off the flight tubes by a similar sapphire sphere assembly. The flight tube assembly itself is supported and located within the vacuum enclosure by machined insulating supports.

The ion source 12 in the present invention employs second-order spatial correction. That is, an algebraic expression is calculated for the total time-of-flight of the ions from the instant they first experience the repeller voltage to the time that they strike the detector surface. The first and second derivatives of this expression with respect to the flight axis co-ordinate are then equated to zero, and the positions of the source repeller and extraction electrodes derived. Specifically, starting with the equation describing the time-of-flight (T) for ions measured with the present invention:

$$T = \frac{\sqrt{2\cdot mass\cdot s}}{\sqrt{q\cdot E_s}} + \frac{\sqrt{2\cdot mass\cdot b}}{2\sqrt{q\cdot s\cdot E_s}} + \frac{\sqrt{2\cdot mass}}{q\cdot E_d}\left(\sqrt{q\cdot s\cdot E_s} - \sqrt{q\cdot d\cdot E_d}\right) + \frac{\sqrt{2\cdot mass}\cdot D}{2\sqrt{q\cdot s\cdot E_s + q\cdot d\cdot E_d}} \tag{1}$$

where:

s=distance from the ion beam to the first grid, $E_s$=extraction field in the s region, b=length of the field free region between the first and second grids, d=length of the high acceleration region between the second and thirds grids, $E_d$=acceleration field in the d region, $D_b$=the location of the spatial focus plane which is in the first flight tube between the ion source and the ion mirror, $D_b$=distance to the second-order space focus under optimum b conditions, and q=ion charge in coulombs.

The first derivative of Equation (1) with respect to s yields:

$$0 = \frac{dT}{ds} = \frac{1}{2}\cdot\frac{\sqrt{2\cdot mass}}{\sqrt{q\cdot s\cdot E_s}} - \frac{\sqrt{2\cdot mass}\cdot b}{4\sqrt{q\cdot E_s}\cdot s^{3/2}} + \frac{\sqrt{2\cdot mass}}{q\cdot E_d}\left(\frac{q}{2}\cdot\frac{E_s}{\sqrt{q\cdot s\cdot E_s + q\cdot d\cdot E_d}} - \frac{1}{2}\frac{\sqrt{q\cdot E_s}}{\sqrt{s}}\right) - \frac{1}{4}\sqrt{2\cdot mass}\cdot D\cdot q\cdot\frac{E_s}{(q\cdot s\cdot E_s + q\cdot d\cdot E_d)^{3/2}} \tag{2}$$

And the second derivative of Equation (1) with respect to s yields:

$$0 = \frac{d^2T}{ds^2} = -\frac{1}{4}\cdot\frac{\sqrt{2\cdot mass}}{s^{3/2}\sqrt{q\cdot E_s}} + \frac{3}{8}\cdot\frac{\sqrt{2\cdot mass}\cdot b}{\sqrt{q\cdot E_s}\,s^{5/2}} + \frac{\sqrt{2\cdot mass}}{q\cdot E_d}\left[-\frac{1}{4}\cdot\frac{q^2\cdot E_s^{\,2}}{(q\cdot s\cdot E_s + q\cdot d\cdot E_d)^{3/2}} + \frac{1}{4}\cdot\frac{\sqrt{q\cdot E_s}}{s^{3/2}}\right] + \frac{3}{8}\cdot\frac{\sqrt{2\cdot mass}\cdot D\cdot q^2\cdot E_s^2}{(q\cdot s\cdot E_s + q\cdot d\cdot E_d)^{5/2}} \tag{3}$$

The second derivative is then solved for D to achieve:

$$D = \frac{2(s\cdot E_s + d\cdot E_d)^{3/2}}{E_s^{3/2}\sqrt{s}} - \frac{b(s\cdot E_s + d\cdot E_d)^{3/2}}{(s\cdot E_s)^{3/2}} + \frac{2\cdot s\cdot E_s}{E_d} - \frac{2(s\cdot E_s + d\cdot E_d)^{3/2}}{\sqrt{s\cdot E_s}\cdot E_d} \tag{4}$$

Equation (4) is substituted for D in Equation (2) and the result is solved for b:

$$b = \frac{2}{3}\cdot s + \frac{2}{3}\cdot\frac{(s\cdot E_s)^{5/2}}{E_d(s\cdot E_s + d\cdot E_d)^{3/2}} - \frac{2}{3}\cdot\frac{s\cdot E_s}{E_d} - \frac{(s\cdot E_s)^{5/2}\cdot D}{(s\cdot E_s + d\cdot E_d)^{5/2}} \tag{5}$$

Similar analysis is performed for second order energy focusing through the ion reflector 20 as discussed above with respect to FIGS. 4 and 5. The end result of the second order spatial focusing and second order energy focusing is second order correction of the TOF-MS 10 for both spatial and energy inhomogeneities in the ion source 12.

From the foregoing description, it will be recognized by those skilled in the art that an improved reflectron time-of-flight mass spectrometer offering advantages over the prior art has been provided. Specifically, the improved reflectron time-of-flight mass spectrometer provides improved design features in both the ion source and the ion reflection region. The ion source employs a near-ground voltage configuration and second-order spatial focusing of generated ions. The ion mirror is a new two-stage, second-order-corrected, energy-focusing, gridless design. As a result of these improvements, it will be seen that superior mass resolution, superior sensitivity, and superior safety, utility, and operational characteristics are achieved.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, we claim:

1. An improved reflectron time-of-flight mass spectrometer (TOF-MS) comprising:

an ion source for generating and accelerating ions along a flight path, said ion source being referenced substantially to ground voltage potential, said ion source employing a second-order spatial focusing condition along an entire flight path of ions formed in said ion source;

a first conducting flight tube and a second conducting flight tube, each of said first and second conducting flight tubes being insulated from a vacuum enclosure and surrounding a flight path of said ions, said first and second conducting flight tubes being electrically floated to a chosen controlled voltage and defining a terminal end;

a gridless ion reflector disposed at said terminal end of said first and second conducting flight tubes, said gridless ion reflector being positioned along said flight path for receiving and reflecting said ions, said gridless ion reflector including at least one gridless decelerating electrode;

a focusing device for applying electrical voltages to said ion reflector for decelerating said ions from said first conducting flight tube and redirecting said ions into said second conducting flight tube, said focusing device employing a second order energy focusing criterion for correcting to second order a total time of flight of ions of varied initial energies and equal mass formed in said ion source; and a detector disposed at an exit end of said second conducting flight tube.

2. The improved reflectron time-of-flight mass spectrometer of claim 1 wherein said at least one gridless decelerating electrode includes a plurality of substantially identical gridless diaphragm rings disposed in a stacked orientation in order to achieve curved equipotential lines which correct for diverging ion trajectories thereby causing all said ions to strike said detector.

3. The improved reflectron time-of-flight mass spectrometer of claim 2 wherein said plurality of gridless diaphragm rings are arranged in at least a first group and a second group, a first voltage being applied to said first group of gridless diaphragm rings and a second voltage being applied to said second group of gridless diaphragm rings to accomplish reflecting and focusing of said ions onto said detector.

4. An improved reflectron time-of-flight mass spectrometer (TOF-MS) comprising:

an ion source for generating and accelerating ions along a flight path, said ion source being referenced substantially to ground voltage potential, said ion source employing a second-order spatial focusing condition along an entire flight path of ions formed in said ion source;

a first conducting flight tube and a second conducting flight tube, each of said first and second conducting flight tubes being insulated from a vacuum enclosure and surrounding a flight path of said ions, said first and second conducting flight tubes being electrically floated to a chosen controlled voltage and defining a terminal end;

a gridless ion reflector disposed at said terminal end of said first and second conducting flight tubes, said gridless ion reflector being positioned along said flight path for receiving and reflecting said ions, said gridless ion reflector including a plurality of substantially identical gridless diaphragm rings disposed in a stacked orientation in order to achieve curved equipotential lines which correct for diverging ion trajectories, said plurality of gridless diaphragm rings being arranged in at least a first group and a second group;

a focusing device for applying a first electrical voltage to said first group of gridless diaphragm rings and a second voltage to said second group of gridless diaphragm rings for decelerating said ions from said first conducting flight tube and redirecting said ions into said second conducting flight tube, said focusing device employing a second order energy focusing criterion for correcting to second order a total time of flight of ions of varied initial energies and equal mass formed in said ion source; and a detector disposed at an exit end of said second conducting flight tube such that said gridless ion reflector causes all of said ions to strike said detector.

* * * * *